United States Patent [19]

Brieger et al.

[11] Patent Number: 4,498,541

[45] Date of Patent: Feb. 12, 1985

[54] METHOD OF WELL COMPLETION

[75] Inventors: Emmet F. Brieger, Albuquerque, N. Mex.; Flint R. George; Edward A. Colle, Jr., both of Katy, Tex.

[73] Assignee: GEO Vann, Houston, Tex.

[21] Appl. No.: 590,680

[22] Filed: Mar. 19, 1984

Related U.S. Application Data

[63] Continuation of Ser. No. 490,295, May 2, 1983.

[51] Int. Cl.[3] ..... E21B 43/116

[52] U.S. Cl. ..... 166/297; 166/188; 166/369; 175/4.52

[58] Field of Search ..... 166/297, 133, 188, 317, 166/369; 175/4.52, 4.54, 4.56; 137/68 R

[56] References Cited

U.S. PATENT DOCUMENTS

| | | | |
|---|---|---|---|
| 2,601,122 | 6/1952 | McKinley | 175/4 |
| 3,001,536 | 9/1961 | Casey | 137/72 |
| 3,024,846 | 3/1962 | Gage | 166/317 |
| 3,966,236 | 6/1976 | Vann | 285/39 |
| 4,059,157 | 11/1977 | Crowe | 166/317 |
| 4,154,303 | 5/1979 | Fournier | 166/317 |
| 4,299,287 | 11/1981 | Vann et al. | 166/297 |

*Primary Examiner*—Stephen J. Novosad
*Assistant Examiner*—Thuy M. Bui

[57] ABSTRACT

A perforating gun is suspended downhole in a cased borehole, in underlying relationship relative to a packer device, and adjacent to a hydrocarbon-bearing formation to be completed. A connecting tubing interconnects the gun with the packer device, and includes a rupture barrier therebetween which prevents debris from accumulating within a gun firing head. An upper tubing string is removably connected to the packer device and forms a passageway which extends from the surface of the earth, down through the packer, and to the gun firing head. The upper tubing string includes a seal means and an extension tube which sealingly engages the packer device and penetrates the rupture barrier to provide a passageway through which the gun can be fired from the surface of the earth. This combination of elements prevents malfunction of the gun when the tool is left downhole for an appreciable length of time.

15 Claims, 6 Drawing Figures

METHOD OF WELL COMPLETION

This is a continuation of application Ser. No. 490,295 filed May 2, 1983.

REFERENCE TO RELATED APPLICATIONS

This application is one of a group of patent applications assigned to a common assignee all contemporaneously filed and relating to bottom hole completions, including patent application Ser. No. 385,707, filed 6-7-82, entitled "Gun Firing System Using Fluid Filled Pressure Balance Tubing"; patent application Ser. No. 385,708 filed 6-7-82, entitled "Well Cleanup and Completion Method and Apparatus"; and patent application Ser. No. 383,746, filed 6-1-82, entitled "Well Cleanup and Completion Apparatus". Other related patents and applications of assignee include U.S. Pat. No. 4,040,482, entitled "Optional Fire and Release Tool and Method" and U.S. patent application Ser. No. 175,515, filed Aug. 5, 1980, entitled "Ball Switch Revise and Method". These cited patents and applications and the art cited with respect thereto are presented to the U.S. Patent and Trademark Office in order to make disclosure of Applicant's prior art knowledge.

BACKGROUND OF THE INVENTION

After a borehole has penetrated a formation and a casing has been cemented in place, the hydrocarbon-containing formation must be communicated with the wellhead so that valuable hydrocarbons can be extracted from the wellbore. Roy R. Vann U.S. Pat. Nos. 3,706,344 and 3,871,448 teach a permanent completion technique which can advantageously be employed in completing a borehole. Reference is made to these prior patents, to Patent Nos. 3,931,855; 3,812,911; and 4,040,485; and to the art cited therein for further background of the present invention.

The well completion method and apparatus of the present invention is particularly applicable to deep, high-temperature, high-pressure wells. For example, such a well might be over 10,000 feet deep, have a bottomhole temperature of about 300° F., and bottomhole pressure of over 5,000 psi. Because of this environment, it is essential for safety reasons that control be maintained over the well at all times. Such control is maintained by using a hydrostatic head of well fluids such as mud to insure that the bottomhole pressure exceeds the formation pressure and later setting a packer in the cased borehole.

The hydrostatic head of drilling mud is maintained in the well to control the high-pressure production zone. The object is to prevent a blowout of the well. Any replacement of the mud with a lighter clean fluid prior to the setting of the packer removes the margin of safety. Thus, it is desirable to keep heavy mud in the well as long as possible to insure that the production zone is killed even if there is a casing leak, for example. Once the packer has been set and the cased borehole can be sealed off, the margin of safety can be maintained. The hydrostatic head is still maintained in the annulus above the packer. A permanent packer is almost always used in a deep, hot, high-pressure well. A permanent packer will contain and withstand the temperatures and pressures of such a well since a permanent packer is a more heavy-duty packer. Thus, very few customers will permit a retrievable packer in such a well where the retrievable packer is mounted on a tubing string with a perforating gun. Such a packer is considered not strong enough to insure the control of the differential pressures and high temperatures in the well. For example, such a packer might fail after the mud was removed with a lighter fluid in the tubing string or where the tubing string is swabbed dry in preparation for perforation. A retrievable packer, mounted on a tubing string with a perforating gun, is generally inadequate for a well with this environment.

The tool string with permanent packer, perforating gun, and other associated apparatus may be run into the well either on a wireline or on a tubing string. It is much more convenient to run the permanent packer in on a wireline rather than a tubing string, however, since less rig time is used. If a tubing string is used, one must come back out of the hole after the packer is set. Once out of the hole, the packer setting tool is taken off the tubing string and then a sealing nipple is run back into the well. This procedure adds almost another day to the well completion.

Although the wireline is preferred, the tool string may have to be lowered on a tubing string where the tool string is very heavy, as for example, with a heavy, long perforating gun or a string of perforating guns. In using a tubing string to lower and set the permanent packer and tool string, the tubing string is released from the permanent packer and removed from the well after the packer has been set.

When a permanent packer, such as described, is required because of the well environment, the tool string is not a closed system, i.e., such as with a vent assembly that keeps mud out of the string. There must be a flow path for circulation to remove the mud. Such a flow path must be available upon running the packer into the hole. Thus, the tool string on the permanent packer completely fills up with drilling mud as it is run into the hole and left in the hole for a long period of time prior to completing the well. The tool string is completely surrounded with drilling mud from the mud in the well.

Thus, it is often desirable to be able to carry out the necessary steps to suspend a perforating gun from a permanent packer device while the drilling rig is on location, and to complete the well at some subsequent time. There are also advantages in running in and setting the permanent packer with tool string in the well and leaving the tool string downhole for several days before completing the well. It may be desirable to leave the downhole dormant for a period of time. For example, one may wish to leave the downhole dormant until one is prepared to complete several wells and tie them all in at one time. However, when a tool is left downhole in a borehole, the surrounding mud often contaminates the interior of the tool. This is because the heavy particles of the mud and other suspended matter gravitate toward the bottom of the tool string where the contaminant densifies into a heavy layer of material. The longer the tool string is left downhole, the more the drilling mud is permitted to settle and congeal. In a perforating gun having a bar actuated gun firing head, for example, it is possible for the mud to densify about the gun firing head mechanism and become compacted and viscous to such an extent that the gun firing head cannot be impacted and detonated. The firing mechanism will require 20 ft-lbs of impact for detonation. Where the mud is permitted to settle and congeal, it may well be impossible to attain 20 ft-lbs of impact from the bar. Thus, it is an advantage to prevent the mud and debris from collecting around the firing mechanism and to permit circulation for the removal of any packed mud. Further, it is advantageous to be able to isolate all of the tubing string above the gun and yet easily gain access to the gun firing head so that no contamination thereof can occur. Method and apparatus for accomplishing this purpose is the subject of the present invention.

SUMMARY OF THE INVENTION

Method and apparatus of completing a formation through which a cased borehole extends. A perforating gun is suspended below a packer device, and the packer device is placed downhole in the borehole at a location which positions the perforating gun adjacent to the formation to be completed.

The perforating gun is connected to the packer device by a connection tubing. The tubing includes a sub having a rupture barrier therwithin so that the passageway which extends longitudinally through the central axis of the packer and down to the gun firing head is closed or obstructed by the barrier means, thereby isolating the passageway below the packer means so that contamination of the gun head cannot possible occur. A vent means is positioned near the barrier means and in close proximity of the packer device.

An upper tubing string has a packing seal means connected to the lower marginal end thereof and an extension tube in the form of a snorkel extends downwardly from the seal means. The packer and gun are positioned downhole in the borehole and at any subsequent time the upper tubing string is run into the borehole, whereupon the seal means engages the packer device while the snorkel extends through and ruptures the barrier, thereby providing an isolated flow path from the surface of the earth down to the gun head. Gun firing apparatus is next run downhole through the upper tubing string, packer, connecting tubing string, and into contact with the gun firing head, thereby detonating the gun and perforating the casing.

Production from the formation flows into the lower annulus, up the annulus to the vent, into the tubing string, and up to the wellhead at the surface of the ground.

The connecting tubing includes a vent assembly through which production can occur when the formation is perforated. A popout vent assembly is provided which has radial ports closed by a frangible disk. The disk is ruptured when the pressure differential thereacross exceeds a predetermined value.

Accordingly, a primary object of the present invention is the provision of method and apparatus by which a formation located downhole adjacent to a borehole can be completed in a safe and dependable manner.

Another object of the present invention is the provision of well perforating apparatus which is suspended downhole in a borehole to enable a formation to be completed at a subsequent time while avoiding the occurrence of contamination to the perforating device during the meanwhile.

A further object of the present invention is the provision of a method of containing uncontaminated fluid above a gun firing head of a perforating gun located downhole in a borehole until it is desired to detonate the gun.

A still further object of the present invention is the provision of apparatus by which a passageway leading downhole in a borehole to a perforating gun is maintained isolated until it is desired to detonate the gun and complete the well.

An additional object of the present invention is the provision of method and apparatus for isolating the firing head of a jet perforating gun located downhole in a borehole until the well is subjected to a completion operation at a subsequent time.

One of the advantages of the present system is that it provides many opportunities to overcome any problems which may be encountered during the process. For example, one can stop at any time above the packer to run another log to determine the location of the apparatus.

These and various other objects and advantages of the invention will become readily apparent to those skilled in the art upon reading the following detailed description and claims and by referring to the accompanying drawings.

The above objects are attained in accordance with the present invention by the provision of method for use with apparatus fabricated in a manner substantially as described in the above abstract and summary.

DETAILED DESCRIPTION OF THE PREFERRED EMBODIMENT

Figure 1:
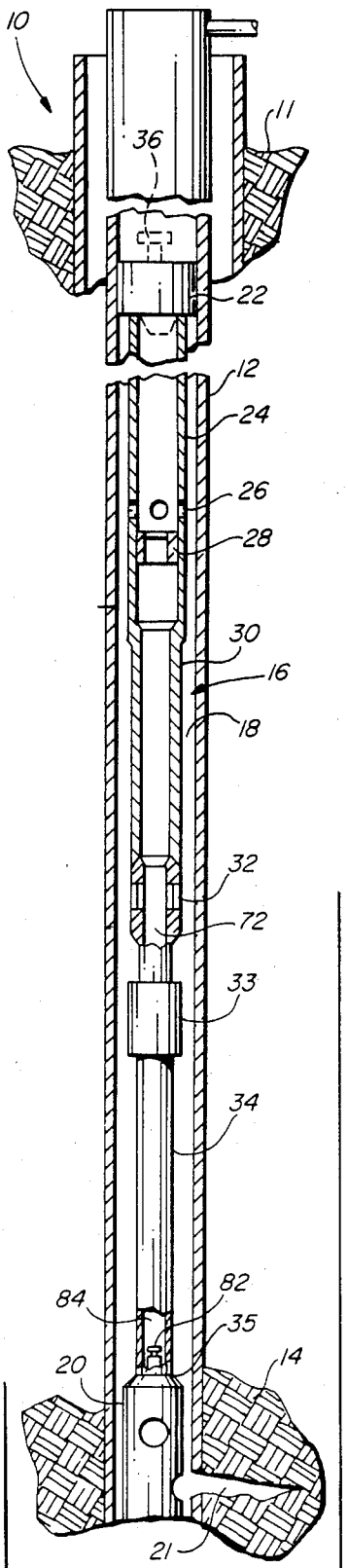
FIG. 1 is a fragmentary, partly diagrammatic, partly schematic, partly cross-sectional elevation of a wellbore having apparatus associated therewith by which the present invention can be carried out.

In the figures of the drawings, and in particular, FIG. 1, there is disclosed a wellhead 10 which protrudes above the surface 11 of the ground in the usual manner. The wellhead is connected to a cased borehole 12 which extends down several thousand feet to a fluid-producing formation 14. Within the casing there is suspended a tool string 16 made in accordance with the present invention. Lower annulus 18 is located between the tool string and the interior of the casing wall. The tool string includes a jet perforating gun 20 having shaped charges associated therewith for penetrating the casing and forming a tunnel 21 back up into the formation as schematically illustrated in FIG. 1.

A permanent packer device 22, which can take on several different forms, has a connecting tubing 24 connected to the lower end thereof. A vent assembly, such as disclosed in U.S. Pat. No. 4,151,880, has a number of vent ports 26 and is connected within the tubing string so that the interior of the tubing can be communicated with annulus 18. A pressure equalizer assembly 28, the details of which will be more fully discussed later on in conjunction with FIGS. 3 and 5, underlies the vent assembly and is connected to tubing 30, which is similar to tubing 24. A popout vent assembly 32, the details of which are more fully described in FIG. 4, is connected within the tubing string. Coupling member 33, which preferably is a releaseable coupling apparatus made in accordance with U.S. Pat. Nos. 3,966,236 or 4,066,282, is connected to tubing 34. Tubing 34 is connected to a gun firing head 35, the details of which are set forth in U.S. Pat. No. 3,706,344. Where deemed desirable, a blanking plug 36, made in accordance with U.S. Pat. No. 3,812,911, can be temporarily placed within the packer device 22 and subsequently retrieved by wireline.

Figure 2:
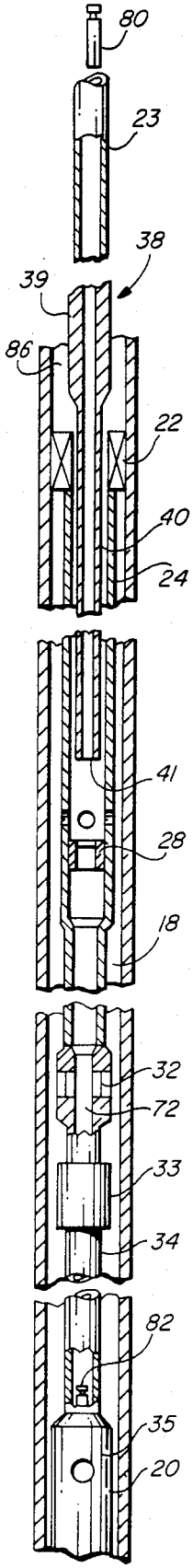
FIG. 2 is similar to FIG. 1 and shows additional apparatus associated therewith.
Figure 5:
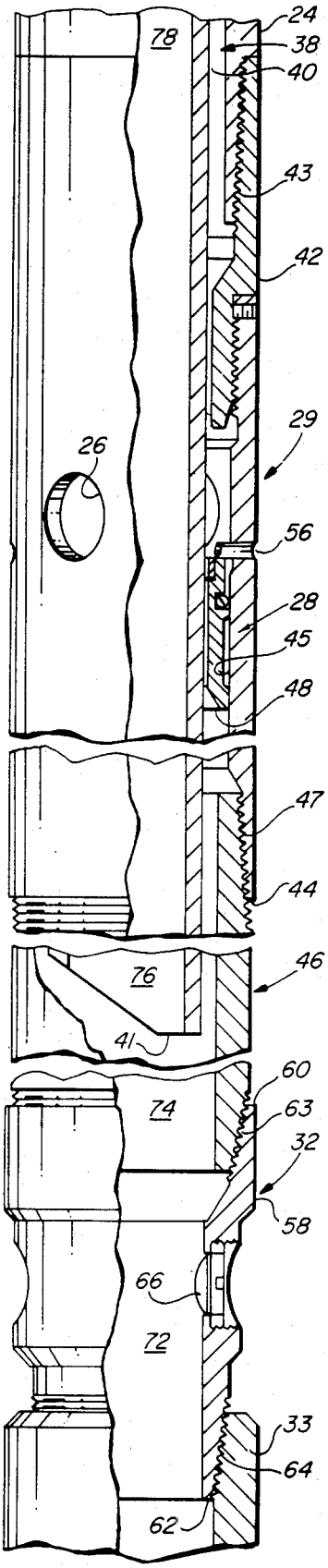
FIG. 5 is a fragmented view which sets forth the details of part of the apparatus disclosed in some of the foregoing figures, with the right side of the figure being shown in crosssection so as to discose the details thereof.

As seen illustrated in FIG. 2, a seal assembly 38 is provided with a seal nipple 39 for sealingly engaging the passageway of the packer device. As seen in FIGS. 2 and 5, a tubing extension in the form of a snorkle 40 is attached to the lower end of the seal, so that the assembly can be run downhole and connected in sealed relationship respective to the packer. In this position, as seen in FIG. 5, the lower terminal end 41 of the snorkle extends past the pressure equalizer assembly 28. Accordingly, when the upper tubing string 23 is manipulated to connect the seal assembly to the packer central passageway, the barrier, or the pressure equalizer assembly, is ruptured, or opened, thereby communicating the interior of the entire tool string with the gun firing head 35, as will be more fully discussed later on.

Figure 3:
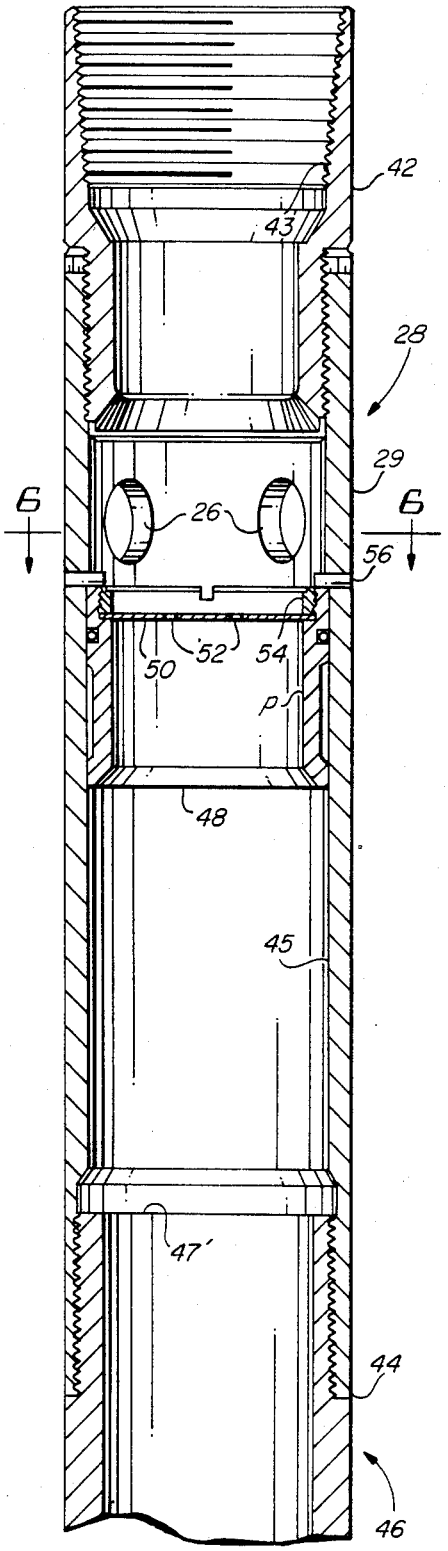
FIG. 3 is an enlarged, longitudinal, cross-sectional view of part of the apparatus disclosed in the foregoing figures.
Figure 4:
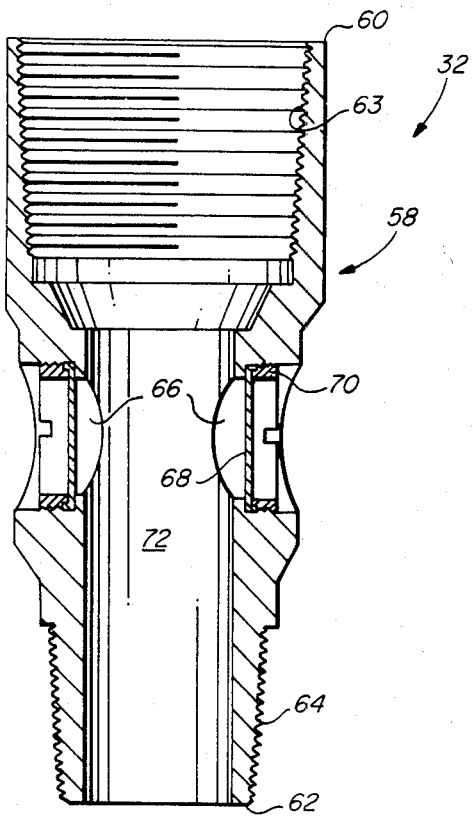
FIG. 4 is an enlarged, longitudinal, cross-sectional detailed view of part of the apparatus disclosed in the FIGS. 1 and 2.
Figure 6:
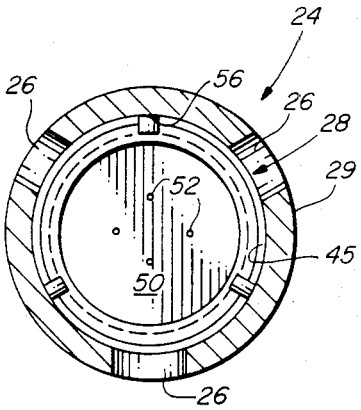
FIG. 6 is a cross-sectional view taken along line 6—6 of FIG. 3.

In FIGS. 3 and 5, there is disclosed a connecting sub 42 which interconnects tubing 24 and the pressure equalizer assembly 28 by means of threaded surface 43. The pressure equalizer assembly has a lower end portion 44. The interior at 45 is polished for sealingly receiving piston 28 in a slidable manner therewithin. Connecting tubing 46 has an upper threaded marginal end 47 affixed to member 29, which presents a shoulder against which lower end 48 of the piston is abuttingly received.

The piston of the equalizer assembly 28 includes a vent diaphragm 50 which is provided with very small diameter apertures 52. Diaphragm or membrane 50 is a very thin sheet of brass approximately 0.002 inches thick. Keeper 54 sealingly affixes the outer peripheral edge portion of the frangible diaphragm member to the piston. A plurality of upper stop members 56 are radially disposed about the interior of member 29 and limit upward movement of the piston.

Tubing 30 and 34 below piston assembly 28 are filled with a light fluid such as water. Other fluids that may be used to fill tubing 30, 34, include diesel and light crude. The piston of the equalizer assembly 28 together with the disk 50 thereof prevents the circulating fluid from passing into tubing 30 and 34. The piston of the equalizer assembly 28 forms a barrier which prevents any mud from ever reaching firing head 35.

The piston of the equalizer assembly 28 is also used to advantageously compensate for any differential expansion. For example, when the tool string is run in on packer 22, the tubing 30, 34 have been previously filled with a light fluid, and that fluid is moved from a relatively cool environment at the surface to a heated environment at the bottom of the hole. Such a temperature change can cause an expansion of tubing 30, 34 or an expansion of the fluid inside tubing 30, 34. To prevent the piston of the equalizer assembly 28 from topping out because of such expansion, weep holes 52 are provided in disk 50 to permit a small amount of fluid flow therethrough. Weep holes 52 also permit the release of air upon assembly. Once tubings 30, 34 are filled with water, the piston of assembly 28 is pushed downwardly and air is permitted to pass through weep holes 52.

The equalizer assembly 28 must be located far enough below packer 22 to avoid any interference between sealing nipple 39 and packer 22. Some seal bore extensions such as seal nipple 39 may have a length between 2 and 12 feet. It is also desirable to have some vertical space between the piston and the packer for the flow of the circulation fluids. In essence, the location of piston of the equalizer assembly 28 is controlled by the length of seal nipple 39.

In FIG. 4, there are disclosed the details of the popout valve assembly 32, which includes member 58. The body member includes an upper end 60, a lower end 62, with there being threads 63 and 64 by which the assembly is connected in series relationship within the tool string. Radial ports 66 are provided within the sidewall of the body and include a rupture diaphragm 68 held into the illustrated position by means of a keeper 70. An axial passageway 72 extends through the popout vent assembly and forms part of the longitudinal passageway which extends from the gun firing head up to the surface of the ground. The longitudinal passageway is best seen in FIG. 5 at 72–78 and extends axially through the entire tool string. A bar 80 can be dropped down through the entire tubing string to impact against trigger device 82 located in the lower extremity 84 of the axial passageway. This action detonates the gun firing head, which in turn detonates all of the shaped charges, thereby perforating the casing.

As seen in FIGS. 1 and 2, together with other figures of the drawings, the packer divides the annulus into an upper annulus 86 and a lower annulus 18.

OPERATION

After the casing has been cemented into place, the drilling rig can be used to install the packer and gun downhole in the position illustrated in FIG. 1. The apparatus remains in this dormant configuration until it is time to complete the well. During this time interval, no debris can contaminate the isolated interior 72–78 of the gun string, and accordingly the gun firing device 35 is left free of foreign matter and therefore unobstructed.

As shown in FIG. 1, the tool string includes a tubing 24 having a vent assembly (U.S. Pat. No. 4,151,880) with vent ports 26 and a pressure equalizer assembly 28; a tubing 30 with a popout vent assembly 32; a tubing release coupling 33 (U.S. Pat. Nos. 3,966,236 or 4,066,282) connecting tubing 30 with tubing 34; and a perforating gun 20 disposed on the end of tubing 34. Gun 20 has a firing head 35. This tool string is attached to a permanent packer 22 and packer 22 is lowered into the well on a wireline. A wireline setting tool on the wireline sets permanent packer 22 for the support of the tool string within the well and locates the perforating gun 20 adjacent formation 14 to be perforated. At this point, there is clean fluid from the surface down through tubing 23 and in tubing 30 and 34 to firing mechanism 35.

Prior to setting the packer, a log of the well is run to be sure that perforating gun 20 is positioned adjacent production zone 14, thereby to assure that the perforations 21 are in the production zone 14.

Once permanent packer 22 has been set and the setting tool removed from the well, a tubing string 23 with a packer seal nipple 39 having a downwardly extending snorkel 40 is lowered into the well to a position as shown in FIG. 2. Snorkel 40 now extends through permanent packer 22 with the lower end 41 of the snorkel being positioned just above the ports 26 of the vent assembly. This is the relative position of the tool string prior to packer seal nipple 39 sealingly engaging the interior of permanent packer 22.

A log may again be run to determine the proper positioning of all the apparatus. The log permits the determination of the number of subs or pipe length required to connect the tubing string 23 at the surface such that snorkel 40 and sealing nipple 39 are properly positioned with respect to packer 22. After a log has been run to determine location, the operator proceeds to space-out the tubing at the surface and flange-up the wellhead. Once the tubing is spaced-out, circulation can occur down tubing 23 and around the end of snorkel 40 and back to the surface right up until the time that sealing nipple 39 sealingly engages permanent packer 22.

A circulation fluid such as water, diesel, light crude or distillate, or nitrogen is pumped down tubing string 23 to wash out the mud which ran into tubing string 23 as it was lowered into the well. The mud in tubing string 23 is washed down through tubing string 23 around the lower end of snorkel 40 with a portion passing through ports 26 and the remainder circulating around the annulus formed between snorkel 40 and tubing 24 and up into annulus 86 to the surface. Upon completion of circulation, tubing string 23 is all free and clean with new circulating fluid extending down to the pressure equalizer assembly 28 since the circulation fluid has now removed most of the heavy mud.

Tubing string 23 with nipple 39 and snorkel 40 are now lowered further into the well so that the end of snorkel 40 ruptures disk 50 in the piston of the equalizer assembly 28. It is not essential that snorkel 40 always rupture the frangible barrier of the piston since assembly 28 can also be ruptured upon the dropping of detonator bar 80. Therefore, snorkel 40 could stop just above or right on top of the piston.

Once sealing nipple 39 sealingly engages packer 22, the pumping of circulating fluid will stop. Since the formation has not yet been perforated, it is not possible to force more fluid into the bottomhole below the packer after the packer seals the annulus. Piston member 50 preferably is pierced or ruptured just prior to sealing nipple 39 sealingly engaging packer 22. It makes no difference that the piston of assembly 28 is ruptured since the mud has now been removed and there is only clean fluid adjacent to the barrier.

Popout vent assembly 32 may be opened either before or after perforating the well. Vent assembly 32 is opened by the creation of differential pressure across assembly 32 so as to cause it to rupture. This of course can occur at the time of perforation but can also occur after the pressure is let off in tubing string 23. Popout vent assembly 32 is generally set to open when a 300 psi pressure differential occurs across it. Thus, popout vent 32 ruptures as soon as the pressure differential across tubing 30 builds up to a predetermined amount. However, it is not essential that the popout vent 32 be ruptured in order for the completion to be successful, noting that production can occur through the vent ports 26.

At this time, actuator bar 80 may be dropped through the clean fluid to fire perforating gun 20.

Upon perforation, the production fluid from formation 14 flows through both popout vent 32 and circulation ports 26. The flow through circulation ports 26 is limited if snorkel 40 has been pushed through piston of the assembly 28 since the entry of snorkel 40 into the piston increases the pressure drop thereacross and thereby partially closes off the flow of production fluids through ports 26 and into the end of snorkel 40.

Where an underbalance for backsurging is desired, the underbalance is created by initially removing the mud from within tubing string 23 prior to seating the packer device. The mud is initially removed through the circulation of lighter fluid down through tubing string 23 and by forcing the mud up the annulus to the surface.

After the mud inside tubing string 23 has been replaced with lighter fluid and sealing nipple 39 has been stabbed into packer 22, pressure can be bled off the tubing string 23 to set a predetermined underbalance of pressure differential in preparation for perforation, thereby to provide for backsurging.

Depending upon the amount of underbalance or differential pressure desired, the lighter fluid in tubing string 23 may be swabbed out and completely removed to obtain a maximum differential pressure or some predetermined column of lighter fluid may be maintained in tubing string 23 to realize a predetermined pressure differential for backsurging. For example, seldom is it desired to have an underbalance greater than 5,000 psi. Where the formation pressure is greater than 5,000 psi, it would be desirable to maintain a hydrostatic head of lighter fluid in tubing string 23 to limit the differential pressure to approximately 5,000 psi. Thus, the underbalance of differential pressure may be controlled by the weight of the circulating fluid in tubing string 23 and the height of the column of that fluid in tubing string 23.

The barrier device 50 is a pressure equalizer assembly which can be perforated by the snorkel to communicate the isolated gun firing head with the surface of the ground. The passageway below the piston preferably is filled with clean water as the lower tubing string is made up. Differential expansion of the fluid and coacting parts are compensated by the variable lower chamber effected by the slidable piston assembly 28. Water can weep from apertures 52 as may be necessary as the apparatus reaches equilibrium downhole in the position seen illustrated in FIGS. 1 and 2. The piston is free to slidably reciprocate between the limits 47 and 56.

The packer and seal are commercially available. The seal surface 39 is composed of 5 chevron seal elements pointed down and another 5 chevron seal elements pointed up so that when member 38 is seated within the central passageway of the packer body, flow is precluded in either direction through the sealed interface.

While a preferred embodiment of the invention has been shown and described, modifications thereof can be made by one skilled in the art without departing from the spirit of the invention.

We claim:

1. Method of completing a formation located downhole of a borehole, comprising the steps of:

(1) locating a perforating gun downhole in the borehole adjacent to the formation to be completed by using a lower tubing string for connecting the perforating gun in underlying relationship relative to a packer device and setting the packer device at the appropriate elevation downhole in the borehole; and, providing a gun firing head at the upper end of the gun for detonating the charges of the gun;

(2) forming a passageway which extends through the packer and to the gun firing head;

(3) placing a barrier within the passageway at a location closely adjacent to the packer to prevent debris from falling downhole towards the gun firing head;

(4) placing a seal nipple on the end of an upper tubing string and running the string downhole until the seal nipple engages the packer and the lower end of the seal means penetrates the barrier to communicate the gun firing head with the upper tubing string;

(5) detonating the gun by running a gun firing device downhole through the tubing string and to the gun firing head so that the gun firing head is actuated and the borehole wall is perforated;

(6) forming a flow path which extends from the formation through the perforations, into the lower annulus, into the lower tubing string at a location below the packer, up through the packer and the upper tubing string, and to the surface of the ground where the production can be gathered.

2. The method of claim 1 wherein step (6) is carried out by forming a radial port through a sidewall of the lower tubing string at a location between the gun head and the packer; and, closing the radial port with a frangible element which is opened to flow when the pressure differential across the port exceeds the structural integrity of the frangible element.

3. The method of claim 1 herein step (3) is carried out by placing a thin diaphragm perpendicularly relative to the longitudinal axis of the tool string and selecting the strength of the diaphragm so that the end of the seal engages and ruptures the diaphragm, thereby enabling communication to be effected across the diaphragm.

4. The method of claim 3 and further including the step of filling the string below the diaphragm with a noncompressible fluid.

5. The method of claim 4 and further including the step of placing a retrievable plug within the packer when the packer is set, and retrieving the plug at a subsequent time when the well is to be completed.

6. The method of claim 1 wherein step (2), includes providing a gun firing head which is responsive to impact, and step (5) further includes the step of dropping a bar down the interior of the tubing string and causing the bar to impact against the firing head.

7. The method of claim 6 wherein step (6) is carried out by forming a radial port through a sidewall of the tubing at a location between the gun head and the packer; and, closing the radial port with a frangible element which is opened to flow when the pressure differential across the port is effected by perforating the borehole.

8. The method of claim 1 and further including the step of:

reciprocatingly placing a piston within the lower tubing string, and supporting the barrier in mounted relationship on said piston.

9. The method of claim 1 wherein step (4) includes flowing cleaning fluid downhole for washing debris from the upper surface of the barrier prior to penetrating the barrier with the end of the seal nipple.

10. The method of claim 9 wherein the barrier is penetrated by extending the lower end of the seal nipple to form a snorkel for engaging and rupturing the barrier.

11. Method of preventing malfunction of a perforating gun while completing a formation located downhole of a borehole wherein the perforating gun is positioned in underlying relationship relative to a packer device and the packer device is set at the appropriate elevation downhole in the borehole to position the perforating gun near the formation to be completed; and a gun firing head is positioned at the upper end of the gun for detonating the charges of the gun; and with there being a passageway which extends through the packer and to the gun firing head; comprising the steps of:

(1) preventing debris from falling downhole towards the gun firing head by placing a barrier means within the passageway in underlying relationship to the packer;

(2) placing a seal nipple on the lower end of an upper tubing string and running the string downhole until the seal nipple is closely adjacent to the packer means and the lower end of the seal nipple is closely adjacent to the barrier means; flowing cleaning fluid down the upper tubing and through the seal nipple to displace fluid from the interior of the lower tubing string to thereby wash debris from the upper surface of the barrier means; engaging the packer with the seal nipple and using the lower end of the seal nipple to penetrate the barrier means which communicates the gun firing head with the upper tubing string;

(3) detonating the gun by running a gun firing device downhole through the tubing string and to the gun firing head so that the gun firing head is actuated and the borehole wall is perforated; and (4) forming a flow path which extends from the formation, through the perforations, into the lower annulus, into the lower tubing string at a location below the packer, up through the packer and the upper tubing string, and to the surface of the ground where the production can be gathered.

12. Method of completing a well comprising the steps of:

(1) assembling a tool string including port means, barrier means, vent means, and perforating means connected in series;

(2) housing the detonator of the perforating means in the tool string below the barrier means;

(3) suspending the tool string from a packer in the well;

(4) running a pipe string with a seal nipple down into the well;

(5) circulating down through the pipe string;

(6) sealing the seal nipple with the packer;

(7) dropping a detonating means through the pipe string and tool string to actuate the detonator to fire the perforating means; and (8) opening the vent means to the flow of production fluids.

13. The method of claim 12, including after step (2), the step of filling the tool string below the barrier means with a fluid.

14. The method of claim 12, including after step (5), circulating through the port means.

15. The method of claim 12, including after step (5), penetrating the barrier means with the seal nipple.

* * * * *